US007134164B2

(12) United States Patent
Alton

(10) Patent No.: US 7,134,164 B2
(45) Date of Patent: Nov. 14, 2006

(54) VACUUM CLEANER NOZZLE ASSEMBLY HAVING EDGE-CLEANING DUCTS

(76) Inventor: James R. Alton, 811 N. Garden St., #3, Bellingham, WA (US) 98225

( * ) Notice: Subject to any disclaimer, the term of this patent is extended or adjusted under 35 U.S.C. 154(b) by 507 days.

(21) Appl. No.: 10/352,650

(22) Filed: Jan. 27, 2003

(65) Prior Publication Data

US 2003/0140449 A1 Jul. 31, 2003

Related U.S. Application Data

(60) Provisional application No. 60/351,810, filed on Jan. 25, 2002.

(51) Int. Cl.
*A47L 9/02* (2006.01)

(52) U.S. Cl. ..... 15/331; 15/416

(58) Field of Classification Search ..... 15/331, 15/375, 416
See application file for complete search history.

(56) References Cited

U.S. PATENT DOCUMENTS

| | | | | |
|---|---|---|---|---|
| 1,782,882 A | | 11/1930 | Rippey | |
| 3,377,647 A | * | 4/1968 | Hill et al. | 15/416 |
| 3,942,216 A | | 3/1976 | Minton | |
| 3,942,219 A | | 3/1976 | Johnson | |
| 4,023,234 A | | 5/1977 | Martinec et al. | |
| 6,039,817 A | | 3/2000 | Payne | |
| 6,052,866 A | * | 4/2000 | Tuvin et al. | 15/416 |

* cited by examiner

*Primary Examiner*—Theresa T. Snider
(74) *Attorney, Agent, or Firm*—Todd N. Hathaway

(57) ABSTRACT

A vacuum cleaner nozzle assembly having at least one auxiliary suction opening along an edge thereof for picking up dirt and debris as the nozzle is moved along a wall or other obstruction. The auxiliary suction openings may be on both sides of the nozzle assembly, located proximate the ends of the primary intake opening. Auxiliary suction ducts connect the auxiliary intake openings to an internal plenum that also supplies vacuum to the main intake opening. The primary and secondary airflows merge in the plenum for withdrawal and collection. The nozzle assembly may be a power nozzle having a roller brush and a drive motor, or may be an unpowered carpet nozzle.

19 Claims, 15 Drawing Sheets

VACUUM CLEANER NOZZLE ASSEMBLY HAVING EDGE-CLEANING DUCTS

This application claims the benefit of U.S. Provisional Application No. 60/351,810 filed Jan. 25, 2000.

BACKGROUND a. Field of the Invention

The present invention relates generally to vacuum cleaners for use on carpeted and non-carpeted surfaces, and, more particularly, to a vacuum cleaner nozzle assembly having at least one suction duct with an intake opening located along an edge of the housing for enhanced cleaning close to a wall or other obstruction.

b. Related Art

The cleaning power of a vacuum cleaner is generated primarily by its suction motor, largely in the form of "airflow," a rapid movement of air that carries dust and dirt from the surface being cleaned to a dirt receptacle, such as a disposable paper bag or a removable bagless container.

Vacuum cleaners normally employ a nozzle to apply the airflow to the carpet or other surface being cleaned. Non-motorized "carpet nozzles" and motor-powered "power nozzles" are engineered to create an effective airflow pattern for cleaning carpeted surfaces, with power nozzles having the added benefit of a spinning, bristled "roller brush" which agitates the carpet and loosens embedded dirt.

A long-standing difficulty with conventional nozzle assemblies, whether of the carpet or the power type, is their inability to clean effectively in areas very close to a wall or other obstruction. For example, the edge of a carpeted area where this meets the wall often forms a crevice which tends to collect dirt and debris that conventional nozzle assemblies have difficulty removing.

Designers have attempted to deal with this problem, referred to as "edge-cleaning performance", by positioning the ends of the intake opening (and roller brush, in power nozzles) as close as possible to the lateral edges of the nozzle assembly. However, even when made as thin as possible the end wall of the opening and the end support for the roller brush always create a gap that prevents the cleaning action from reaching into the crevice. In some instances, designers have formed small channels that extend laterally from the main airflow opening and under the roller brush end supports in an effort to generate some suction along the edges of the nozzle assembly but in general these have only a marginal effect; in any event such channels must be quite limited in size or else they will compromise the ability of the assembly to generate an upwards suction force with sufficient airflow when moving over the floor in areas away from the wall.

In an effort to deal with these problems most vacuum cleaners are provided with a separate "crack tool" or "crevice tool", which is a flat, narrow nozzle that is mounted on the end of a suction hose. Although these tools usually work adequately, they add an irksome and tiring step to the edge-cleaning process, requiring the operator to frequently bend over, thereby straining the muscles of his/her back. As a result, traditional "crevice tools" do not provide a satisfactory solution, and are in fact simply not used by many operators.

Another factor impacting the design of a vacuum cleaner nozzle assembly is that the total weight of the assembly must be kept to a minimum for maneuverability and ease of use. Although a number of prior nozzle assemblies have incorporated new features for the purported convenience of the operator and/or better cleaning, the benefits of the features have frequently been negated by additional weight that has made the machines cumbersome and difficult to use.

Accordingly, there exists a need for a vacuum cleaner nozzle assembly that provides an effective cleaning action along both its lateral edges or at least one lateral edge thereof, so as to effectively remove dirt and debris along the junctures between the floor and walls or other obstructions. Furthermore, there exists a need for such a nozzle assembly that provides effective edge-cleaning without compromising the ability of the assembly to provide a vertical suction against floor surfaces when cleaning in areas away from the wall. Still further, there exists a need for such a nozzle assembly that provides effective edge-cleaning in a single pass, without requiring the use of separate tools or additional cleaning steps. Still further, there exists a need for such a nozzle assembly that provides enhanced edge-cleaning without adding significantly to the total weight of the assembly. Still further, there exists a need for such an assembly which is adaptable to use with existing forms of suction-generating motors, roller brushes, drives and other mechanisms associated with conventional vacuum cleaners and nozzle assemblies, so as to minimize the costs for tooling and development thereof. Still further, there exists a need for such a nozzle assembly that is structurally simple, economical to manufacture, and durable in use.

These and other features and advantages of the present invention will be apparent from a reading of the following detailed description with reference to the accompanying drawings.

SUMMARY OF THE INVENTION

The present invention has solved the problems cited above, and provides a secondary airflow pattern that augments the primary airflow patterns of typical carpet nozzles and power nozzles, for the purpose of improving edge-cleaning performance.

Broadly, the invention provides a vacuum cleaner nozzle assembly having a housing having a primary intake opening at least one auxiliary intake opening located along a lateral edge of the housing, and means for supplying suction to the auxiliary intake opening so as to create a secondary airflow that draws dirt and debris into the auxiliary intake opening as the edge of the nozzle assembly is moved along a wall or other obstruction.

The means for supplying suction to the auxiliary intake opening may be through an auxiliary suction duct which has one end in communication with the auxiliary intake opening, and a second end which is in communication with an internal chamber of the nozzle assembly to which suction is applied by the vacuum cleaner's suction motor. The auxiliary suction duct may comprise a somewhat and vertically-extending end section having the auxiliary intake opening formed at a lower end thereof, and a somewhat horizontally-extending lateral section for conveying the dirt and debris to the internal chamber of the nozzle assembly.

The auxiliary intake opening may be located proximate an end of a main intake opening on a lower side of the nozzle assembly, and may be located in generally axial alignment with a roller brush in the main opening. The nozzle assembly may comprise first and second such auxiliary intake openings, located on left and right sides of the assembly.

The vertical end sections of the auxiliary suction ducts may have a flattened cross-section so as to concentrate the secondary airflow pattern and to minimize laterally extending protrusions on the sides of the nozzle assembly. Leading and trailing cutouts may be formed behind a depending outer lip of the end section for channeling dirt and debris into the auxiliary intake opening as the nozzle assembly is moved in forward and rearward directions.

The suction may be applied to the internal chamber of the head assembly through a tubular handle inserted into a hollow barrel/neck fitting of the head assembly. The tubular handle may be removable from the head assembly, and the barrel fitting permits the handle to be raised and lowered relative thereto.

These and other features and advantages of the present invention will be apparent from a reading of the following detailed description with reference to the accompanying drawings.

DETAILED DESCRIPTION

For purposes of illustration, the following description is made primarily with reference to an exemplary power nozzle assembly. However, as will be described below, the invention is equally applicable to carpet nozzle assemblies that lack the roller and motor mechanisms of power nozzles.

a. Overview

Figure 1:
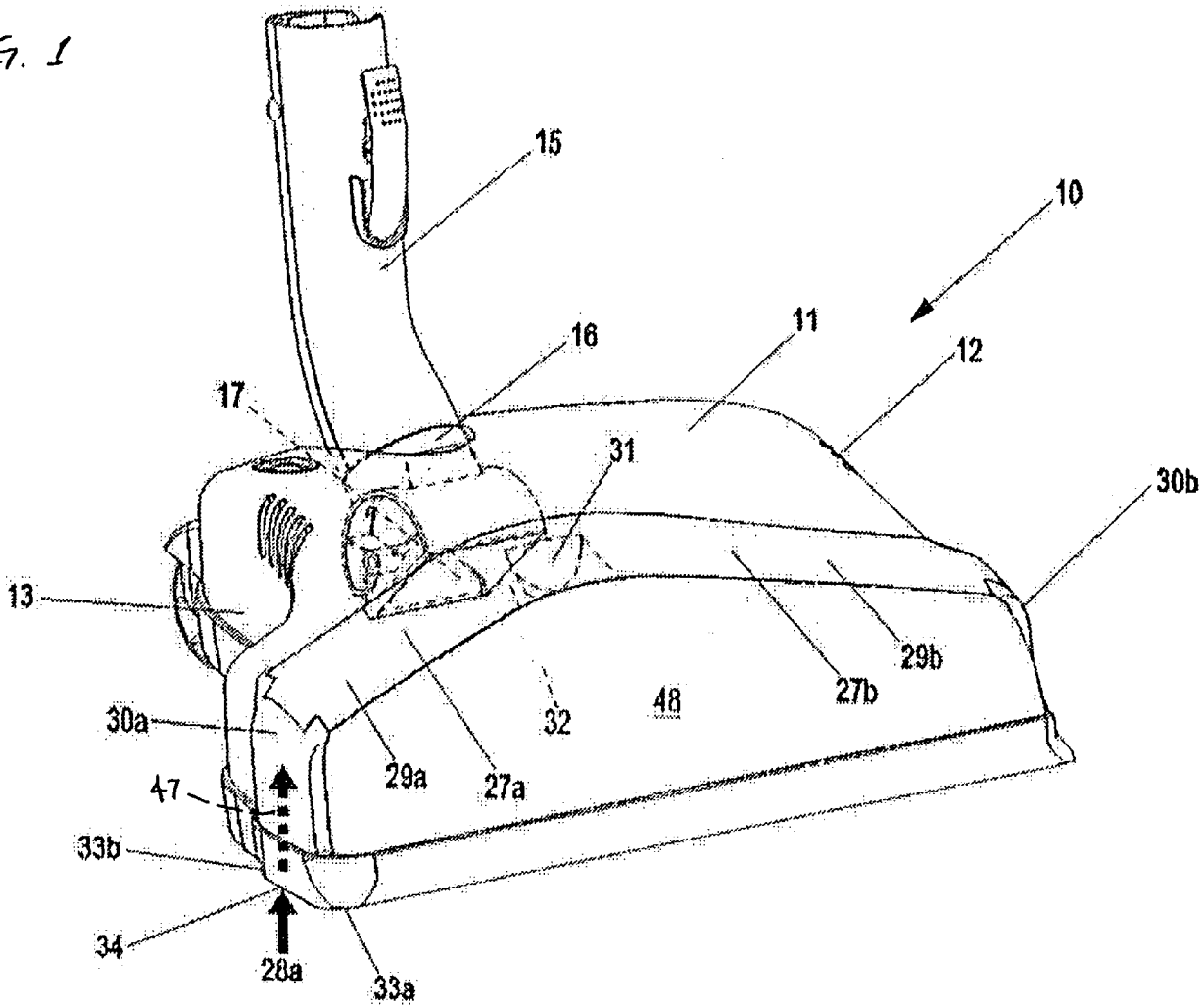
FIG. 1 is a perspective view of a vacuum cleaner power nozzle assembly in accordance with the present invention, showing the first and second auxiliary ducts that provide cleaning suction along the lateral edges of the assembly.

FIG. 1 shows a vacuum cleaner power nozzle assembly 10 in accordance with the present invention. It will be understood that the nozzle assembly constitutes only a portion of the complete vacuum cleaner, and that the nozzle assembly will therefore ordinarily be mounted or connected to a vacuum cleaner body (not shown) that houses the suction motor, dirt collection bag/receptacle, controls, and so on; for example, the main body of the vacuum cleaner may be of the upright or canister type, or may be in the form of an installed "central vac" system. As can be seen the nozzle assembly also includes wheels, casters or other mechanisms for supporting movement over a carpet or other floor surface.

Figure 4:
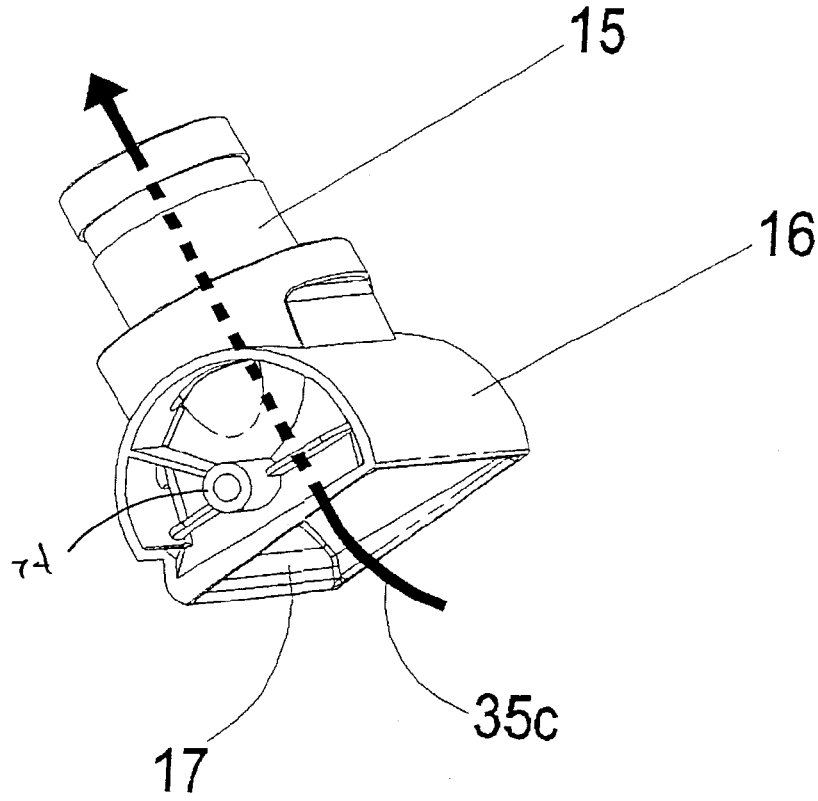
FIG. 4 is a perspective view of the hollow barrel/neck fitting of the nozzle assembly of FIGS. 1–3, showing the manner in which the airflow enters the intake opening thereof and passes into the interior of a tubular handle inserted into the barrel/neck fitting, which is in communication with the vacuum cleaner's suction motor.

The nozzle assembly 10 which is shown in FIG. 1 includes a housing 11 that is somewhat similar to that of a conventional power nozzle assembly, in that this includes left and right sides 12, 13, and a main intake opening 14 (see FIG. 2) that communicates with a hollow plenum within the interior of the housing. A pivoting, upwardly projecting neck/barrel fitting (or "neck") 15 is mounted towards the rear of the assembly, using a pivoting barrel structure 16 or similar fitting that forms a sealed interfit with the internal chamber of the housing. As can be seen in FIG. 4., the "barrel" portion 16 of the hollow neck/barrel fitting has an intake opening 17 that leads from the plenum into the interior of the neck 15. The upper end of the neck, in turn, is in fluid communication with the vacuum cleaner's suction motor (not shown) that supplies the suction airflow to the nozzle assembly.

Figure 2:
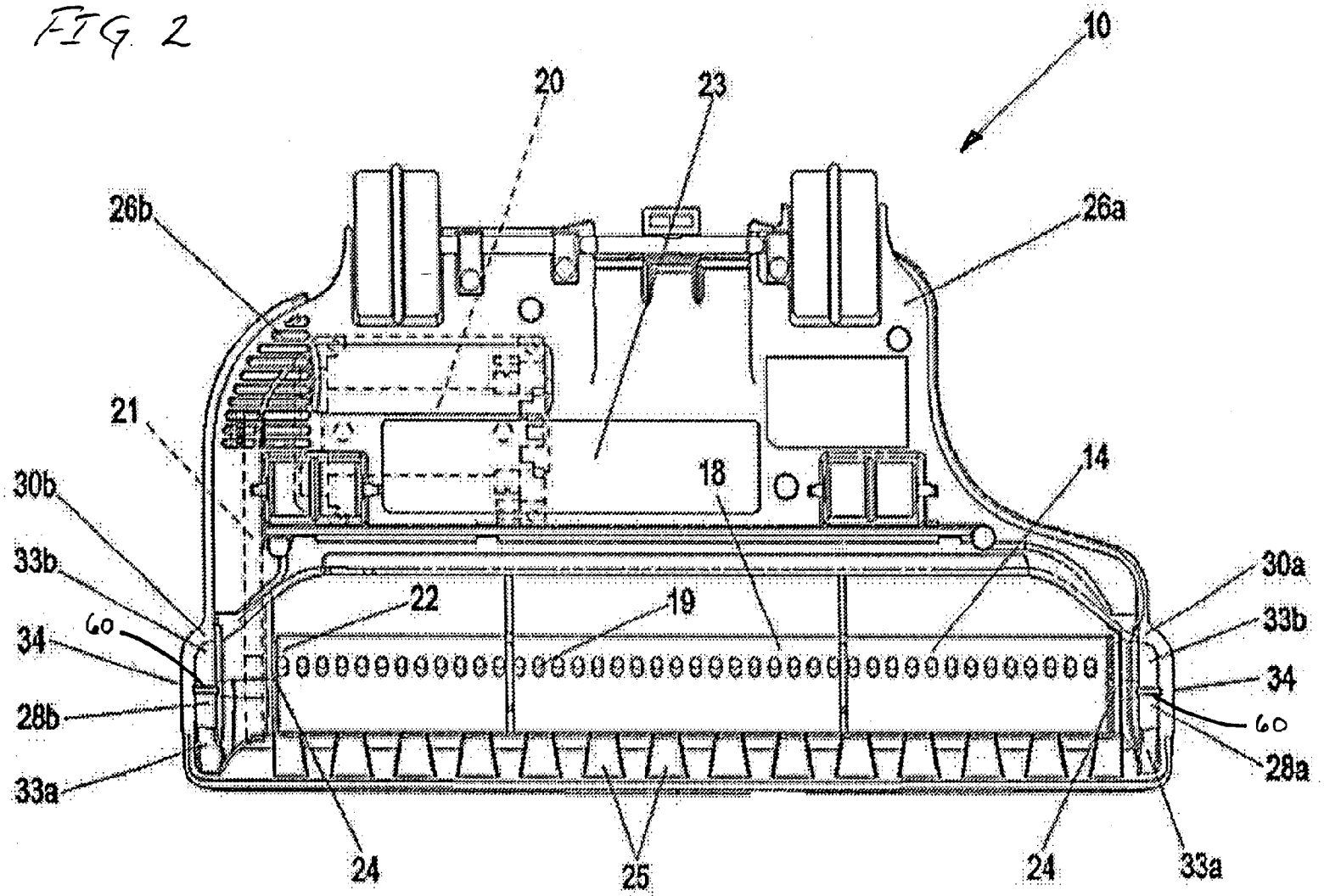
FIG. 2 is a bottom plan view of the power nozzle assembly of FIG. 1, showing the relationship of the auxiliary suction ducts to the main intake opening thereof.

As is shown in FIG. 2, the nozzle assembly also includes a generally conventional roller brush 18 (shown in end view in FIG. 7) that is mounted in register with the main intake opening 14. The roller brush bears one or more rows of bristles 19 which may not be present in all embodiments) and is rotated by a dedicated non-suction motor 20 and drive belt 21 attached to the drive end 22 of the brush. The main intake opening 14 is located in the nozzle's bottom plate 23. Flow channels 24 are formed beneath the roller brush's end supports (not seen) so as to establish lateral communication between the main intake opening 14 and the sides of the assembly, and additional channels 25 formed along the leading edge provide a degree of airflow along the front of the assembly. Wheels, rollers or other supports (not shown) may also be mounted to the housing, as, for example, at trailing corners 26*a*, 26*b*.

Figure 5:
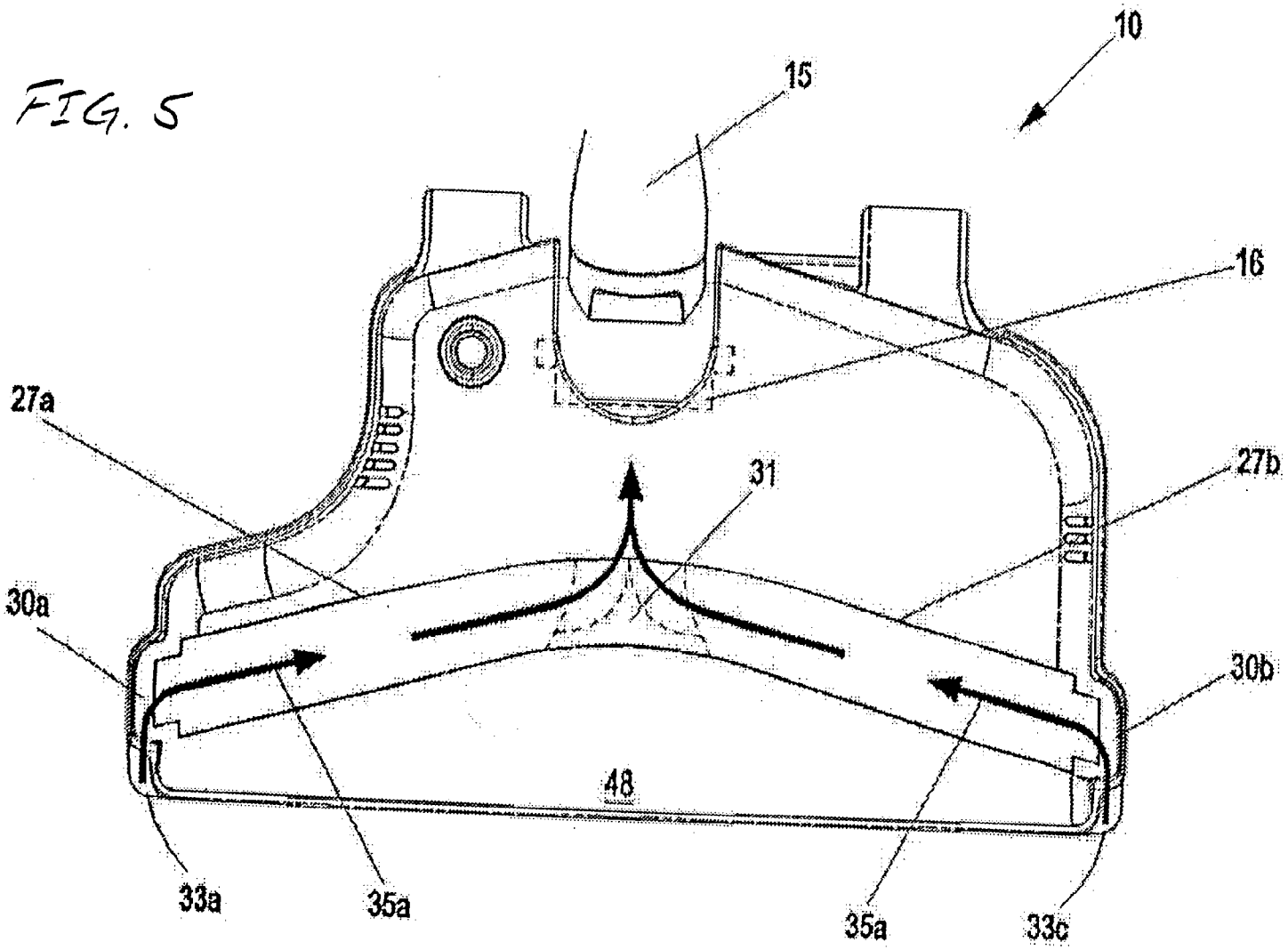
FIG. 5 is a top plan view of the nozzle assembly of FIGS. 1–3, showing the flow paths that are provided by the auxiliary suction ducts in greater detail.

The components described in the preceding paragraphs are largely conventional in layout. However, referring again to FIG. 1, it will be seen that the present invention provides first and second auxiliary suction ducts 27*a*, 27*b* having intake openings 28*a*, 28*b* (see also FIG. 2) for providing increased airflow along the sides 12, 13 of the nozzle assembly. The auxiliary suction ducts include horizontal segments 29*a*, 29*b* that extend across the top of the nozzle housing 11, and the generally vertical end segments 30*a*, 30*b* that extend downwardly over the sides of the housing and terminate at the intake openings 28*a*, 28*b*. The discharge ends of the auxiliary ducts meet at a common "tee-flue" 31 (see also FIGS. 5 and 6) and flow into an interior plenum 32 (see also FIG. 7), which is the same chamber that receives air and debris collected through the main intake opening 14.

Referring again to FIGS 1 and 2, the auxiliary intake openings 28*a*, 28*b* are preferably located at the ends of the main intake opening 14, in approximate axial alignment with the roller brush 18 (see also FIG. 6), although in some embodiments the intake openings may be positioned at locations different from those shown. Each of the openings includes leading and trailing cutaway openings 33*a* and 33*b* formed behind a depending outer lip 34; the cutaway openings allow dirt and debris to be channeled into the larger intake openings 28*a*, 28*b* as the nozzle assembly moves in forward and rearward directions, while the depending lip 34 ensures that the suction force is applied in a mainly vertical direction and is not diminished or dissipated outwardly over the floor.

The vertically-extending end segments 30*a*, 30*b* of the auxiliary suction ducts are somewhat flattened in cross section so as to concentrate the secondary airflow pattern and so as to minimize the protrusions at the sides of the housing, and also so as to form longitudinally elongate intake openings that are oriented in-line with the crevices to be cleaned. The end segments may be angled somewhat rearwardly as shown in the figures, so as to define a more direct flow path and to also help prevent impact damage when accidentally striking furniture legs or other obstructions. In addition, the intakes and duct segments may also be installed flush with, or inside of or around, the nozzle's thick rubber bumper (not shown), which typically wraps around the assembly's perimeter. In addition, the lower forward portions of the vertical end segments 30*a*, 30*b* may be elongated in a forward direction, as shown in FIG. 1B, so that the leading cutaway openings 33*a*, 33*b* are able to reach fully into corners for maximized corner cleaning performance.

Figure 6:
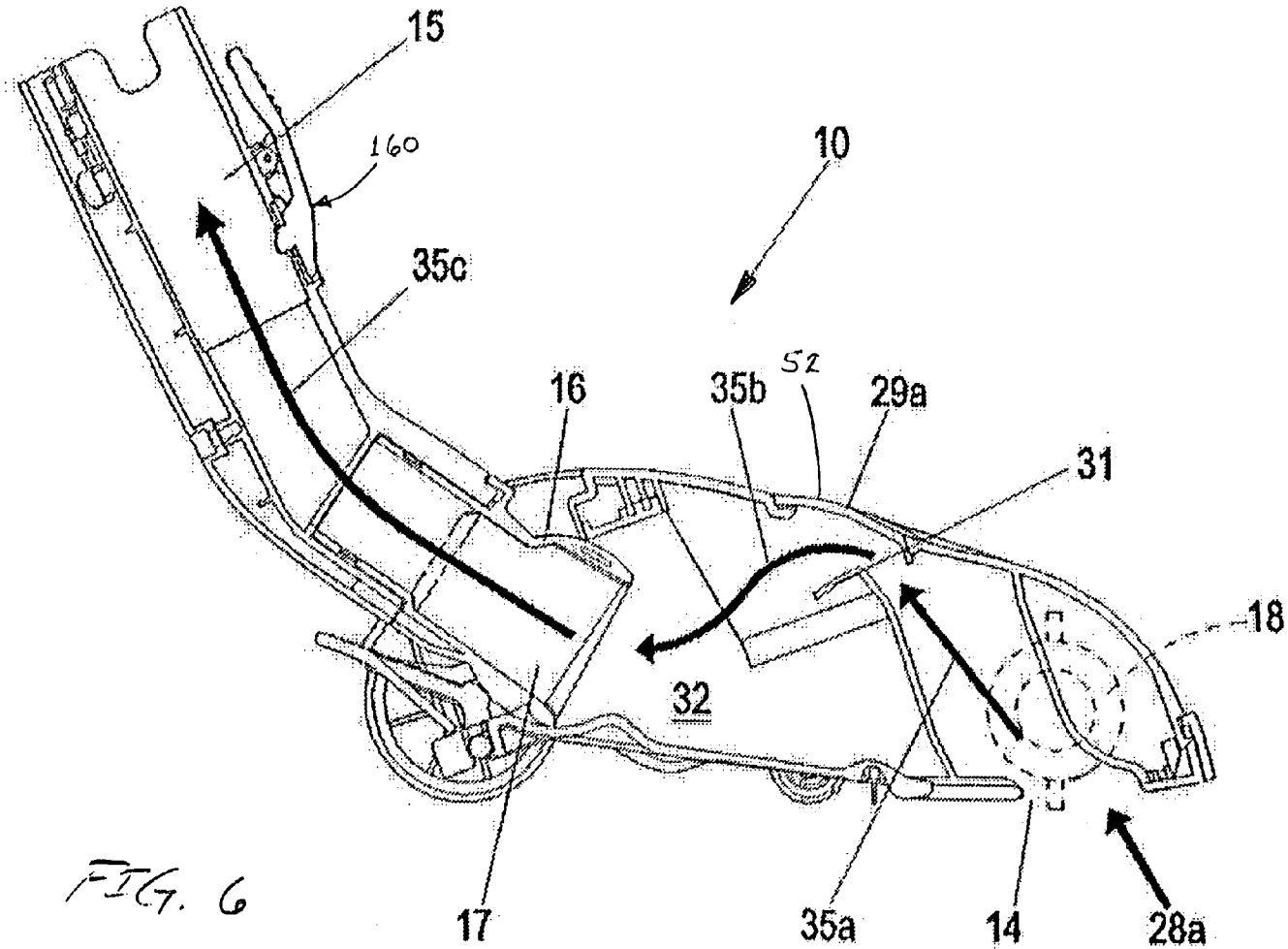
FIG. 6 is a sectional view of the power nozzle assembly of FIGS. 1–3 and 5, providing a side view of the paths of the auxiliary airflow passing therethrough.

As can be seen in FIG. 6, the ducts and conduits may further be angled to define a comparatively smooth and efficient flow path. Moreover, the tee-flue 31 discharges rearwardly and more or less directly into the intake opening 17 of barrel fitting 16. This configuration ensures efficient utilization of the vacuum force that is provided by the vacuum cleaner's suction motor.

Figure 3:
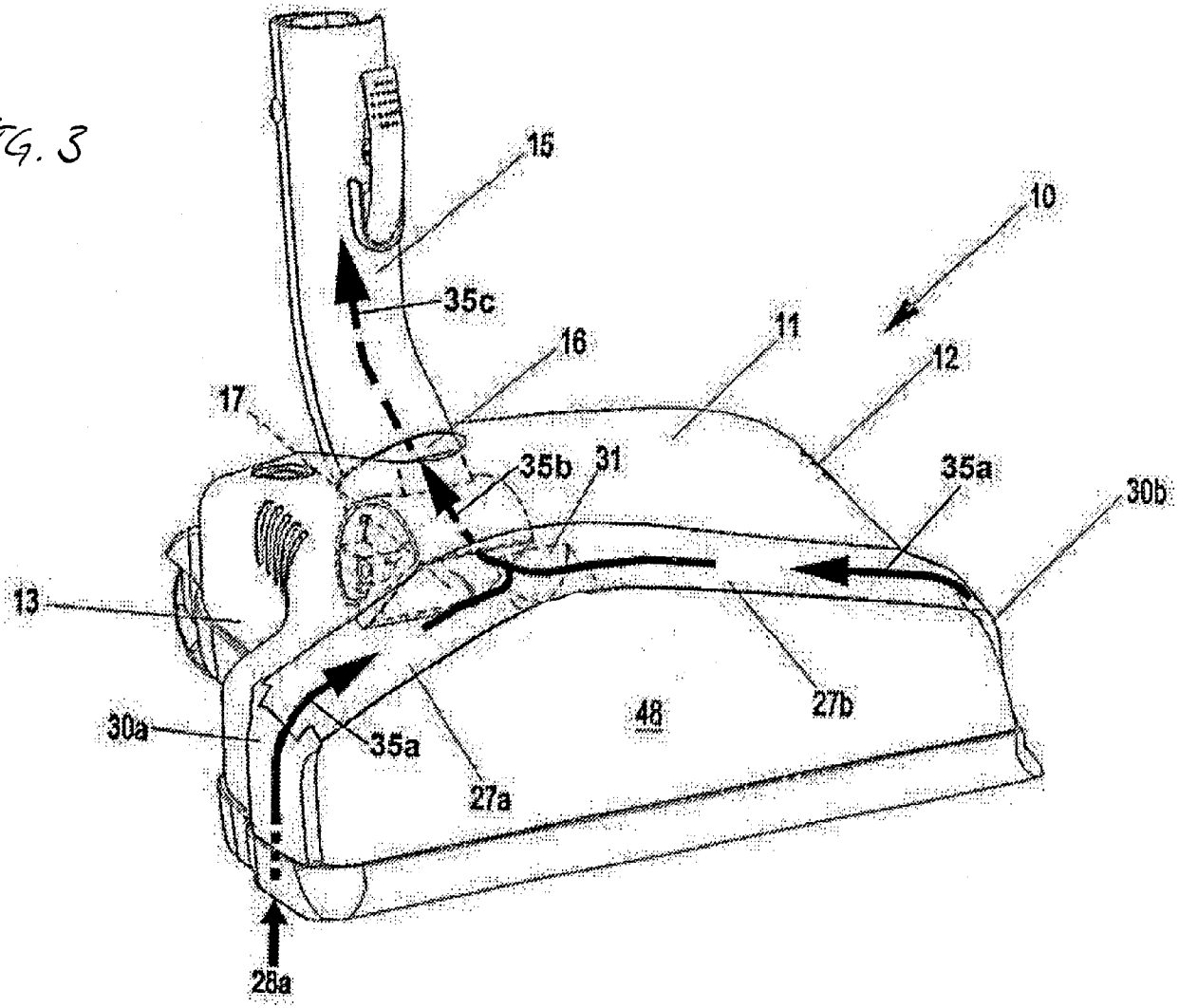
FIG. 3 is a second perspective view of the nozzle assembly of FIG. 1, showing the flow paths by which air is drawn through the auxiliary edge ducts to a conduit communicating with vacuum cleaner's suction motor.

Consequently, when the vacuum cleaner's suction motor is energized, this produces a suction in plenum 32 that draws air and debris upwardly through the auxiliary openings 28*a*, 28*b* and through ducts 27*a*, 27*b*, in the direction indicated by arrows 35*a*, 35*b*, 35*c* in FIG. 3. From the plenum, the air and debris are pulled through opening 17 into the neck 15, merging with the primary airflow and the debris collected through the main intake opening 14.

The auxiliary suction ducts 27*a*, 27*b* of the present invention thus provide upward airflow and direct suction pickups along the left and right sides of the nozzle assembly which effectively removes dirt from the crevices found at the junctures of floors and walls or along the base of furniture or other such impediments to floor or carpet cleaning. The operator simply moves the nozzle assembly along the wall in order for the edge-cleaning action to reach into the crevices, and no additional cleaning tools or steps are needed.

b. Airflow Patterns in Power Nozzle Assembly

Figure 7:
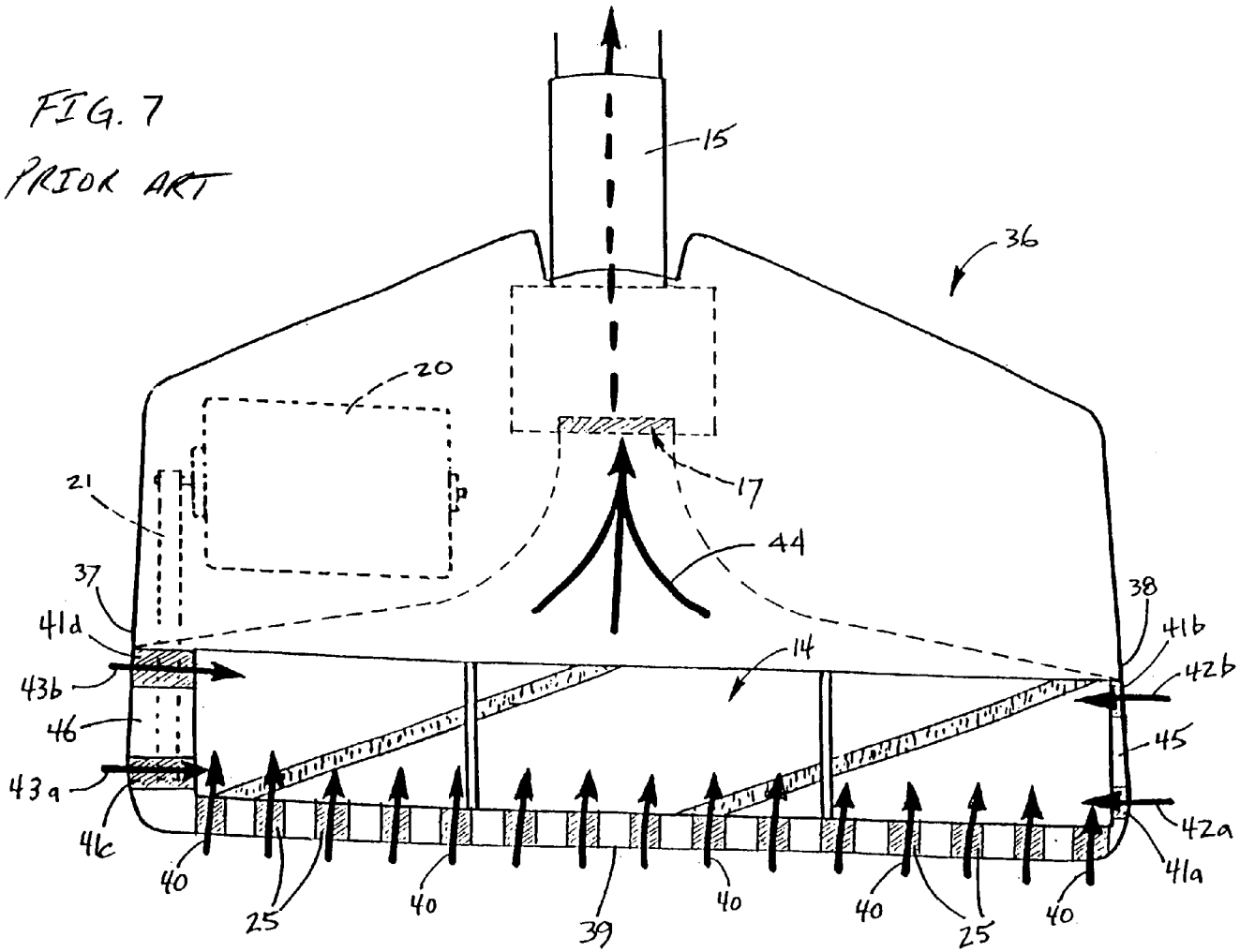
FIG. 7 PRIOR ART
FIG. 7 is a bottom plan view of a prior art form of power nozzle assembly, showing the ineffective and unbalanced edge-cleaning airflow which is characteristic thereof.
Figure 8:
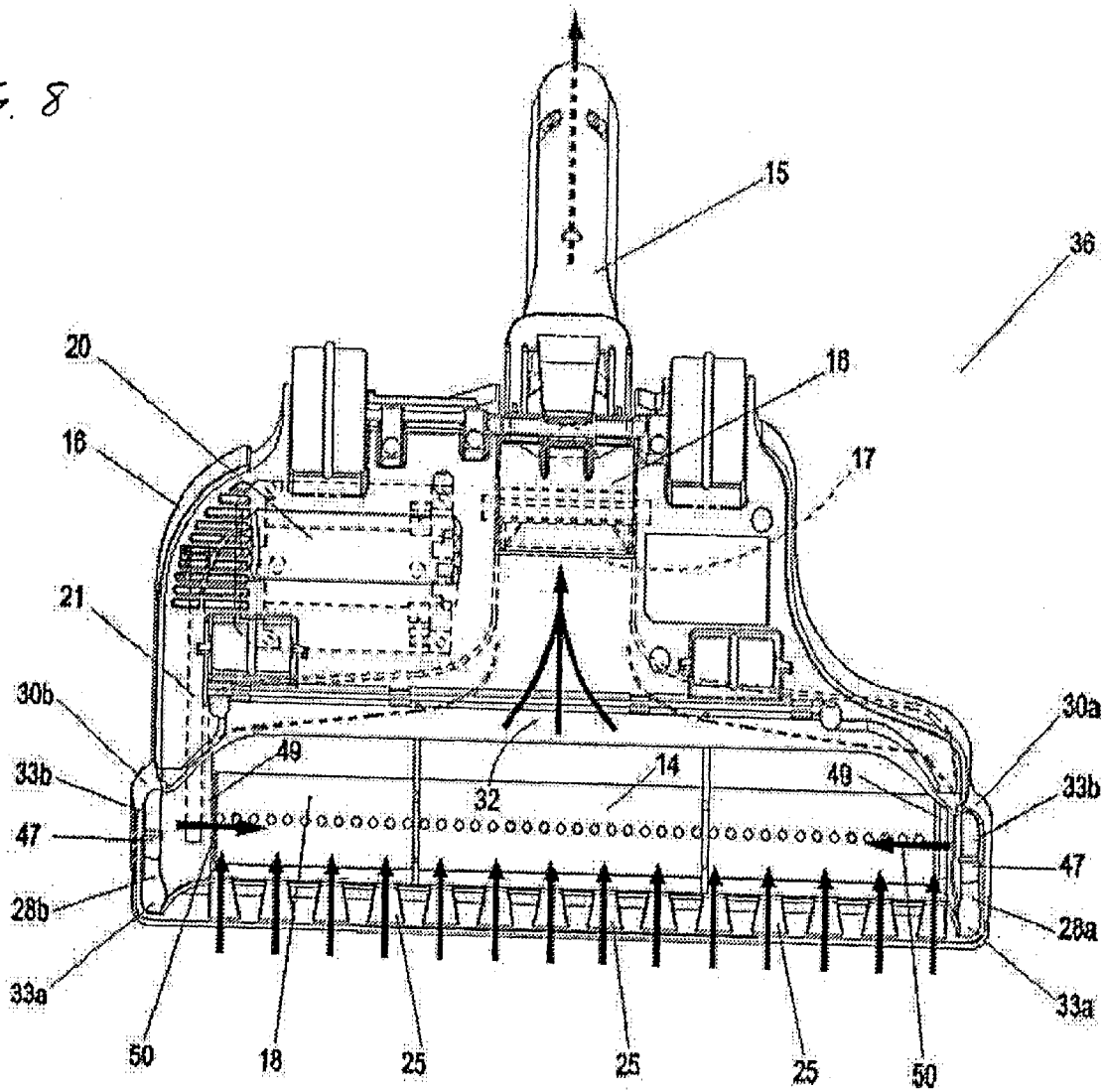
FIG. 8 is a bottom plan view of the power nozzle assembly of FIGS. 1–3, showing the manner in which the auxiliary suction ducts of the present invention provide a greatly improved edge-cleaning airflow on both sides of the assembly, as compared with the prior art form of assembly shown in FIG. 7.

FIGS. 7 and 8 illustrate the enhanced edge airflow patterns that are provided by the present invention when used with a power nozzle assembly.

As can be seen in FIG. 7, without the present invention the edge-cleaning performance of a conventional motor-powered power-nozzle assembly 36 is typically lopsided, ranging from poor-to-fair on the nozzle's wider side 37 (which houses the drive-belt 21 and motor 20), to fair-to-good on the opposite, narrower side 38. Inward airflow generated by the vacuum cleaner's suction motor (not shown) is drawn mostly through the slots 25 along the front 39 of the nozzle, in the direction indicated by arrows 40, and through small side slots 41*a*, 41*b* and 41*c*, 41*d* in the directions indicated by arrows 42*a*, 42*b* and 43*a*, 43*b*. The dust-carrying airflow is thus drawn inwardly to the main intake opening 14 and central plenum area 32, where (as described above) the air, dust and dirt pass into the barrel opening 17 and up through the tubular neck 15 toward the dirt receptacle (not shown), in the direction indicated by arrows 44.

Although the conventional power nozzle has some slight edge-cleaning performance due to the laterally extending channels 41*a*, 41*b* and 41*c*, 41*d*, the amount of lateral airflow is necessarily restricted or else the primary, upward vacuuming force of the main intake 14 will be dissipated outwardly when working in areas away from the wall. The lateral channels 41*a*, 41*b* and 41*c*, 41*d* are therefore necessarily narrow, and are spaced apart by barriers 45, 46, so the edge-cleaning performance is inevitably extremely limited. Moreover, the edge-cleaning performance is further degraded on the nozzle's "wide" side 37, due to the increased length of the channels 41*c*, 41*d* which must span the distance across the drive belt 21.

The present invention improves the edge-cleaning performance of the nozzle assembly, and also approximately equalizes edge-cleaning performance on both sides of the assembly.

As can be seen in FIG. 8, the present invention creates a secondary airflow pattern that augments the primary airflow pattern described above. The secondary airflow pattern includes both:

a) a direct lifting of dust and dirt up into the vertical edge or "crevice" segments 30*a*, 30*b* at the nozzle's left and right forward sides, as indicated by airflow arrows 47; and b) a simultaneous pulling of dust and dirt in through the leading and trailing cutaway openings 33*a*, 33*b* and into the main vertical intake of the vertical duct segments 30*a*, 30*b*.

As was discussed above with regard to FIGS. 3 and 5, the secondary airflow rushes upwardly through the left and right vertical duct segments 30*a*, 30*b* and continues horizontally through horizontal duct segments 27*a* and 27*b* across the nozzle's top area 48. The flows merge at the common tee-flue 31 which is positioned between the roller brush 18 and neck 15 (see FIG. 6), and the tee-flue directs the air, dust and dirt downwardly into the common plenum area 32 while simultaneously angling the flow toward the barrel intake opening 17. The secondary flow then joins the primary airflow in plenum area 32 and continues up and into the dirt receptacle (not shown), in the direction indicated by arrow 35*c*.

Figure 9:
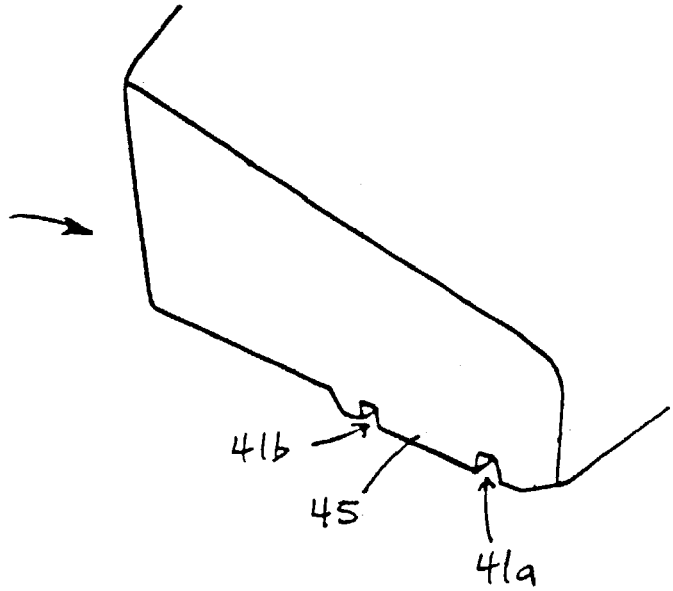
FIG. 9 PRIOR ART
FIG. 9 is a partial, perspective view of the right side of the prior art of nozzle assembly of FIG. 7, showing the narrow, constricted lateral flow channels that are characteristic thereof.
Figure 10:
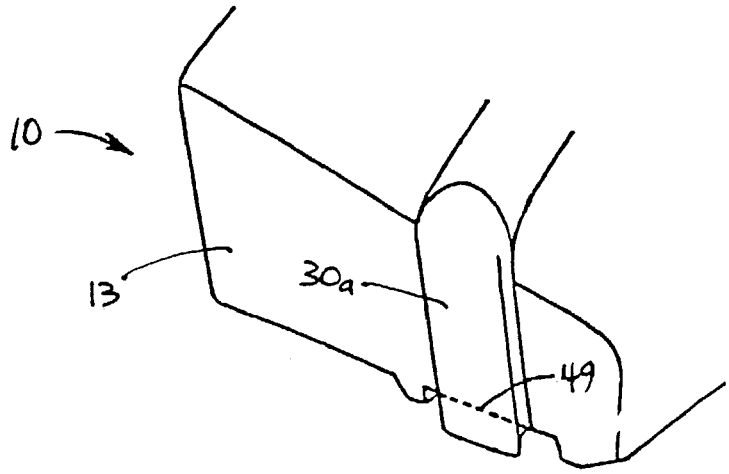
FIG. 10 is a partial, perspective view of the right side of a nozzle assembly similar to that of FIGS. 1–3, showing the manner in which the depending edge ducts of the present invention permit the use of enlarged channels for greatly enhanced lateral airflow, as compared with the constricted flow channels of the prior art assembly shown in FIG. 9.

As can be seen by comparing FIGS. 9 and 10, the presence of the invention's vertical edge ducts and their depending flanges also make it possible to merge the nozzle's lateral flow channels 41*a*, 41*b* to create a single, wide and unobstructed channel 49. In essence, the edge ducts allow the barriers 45 and 46 of the prior art (see FIG. 7) to be eliminated without dissipating or degrading the primary suction at the main intake 14, because the edge ducts also serve as effective barrier replacements. The elimination of the barriers 45, 46 and the resulting increased channel width greatly improves the inward lateral airflow 50 of the primary airflow pattern (see FIG. 8), which in combination with the secondary airflow pattern provided by the edge ducts results in greatly enhanced edge-cleaning performance.

c. Secondary Airflow Paths

As described above, the secondary airflow paths are provided by the first and second auxiliary suction ducts 27*a*, 27*b*. While the number and configuration of the auxiliary ducts may vary somewhat, certain features will be preferable for most embodiments. Primary considerations include maximizing the strength of the secondary airflow, and preventing the secondary airflow paths from becoming plugged or clogged by debris.

As a primary safeguard against plugging, one or more guard pins 160 (see FIG. 2) or similar structures are preferably mounted across the intake openings 28*a*, 28*b*, so as to catch and prevent cloth, paper articles (e.g., tissue paper) or the like from being drawn into the secondary intake ducts. Small diameter metal pins are used in the illustrated embodiment, so that the pins have sufficient strength to catch and hold the articles without being so large as to block or significantly diminish the intack flow.

Once past the guard pins, the internal dimensions of the secondary ducts increase generally progressively until they discharge through the tee flue. This ensures that any pieces of debris that are able to pass through the intake openings, which represent the most constricted point along the paths, will be small enough to pass through the remainder of the ducts without becoming obstructed. The progressive (e.g., tapered) increase in duct size also helps to accommodate the irregularly shaped particles, and also the defamation and slight slow somewhat due to friction. However, it is generally preferable that the increase in size be only relatively slight, rather than widening out greatly, so as to substantially maintain the velocity of the secondary airflow through the whole length of the duct. For example, in the embodiment which is illustrated in FIGS. 1–2, the secondary suction ducts 27*a*, 27*b* suitably have a width of about 7.0 mm at the intake openings 28*a*, 28*b*, tapering outwardly to a width of about 7.5 mm at the junctions between the vertical and horizontal sections, and increasing to about 9.0 mm at the discharge into the tee flue 31.

In order to further facilitate passage of debris through the secondary ducts, the sharpest turn is preferably positioned closest to the intake opening, with subsequent turns being progressively more gradual. Thus, as can be seen in FIGS. 1 and 3, the approximately 90° (in the vertical plane), turn, between the vertical and horizontal sections is the first after the intake opening and is located relatively close (e.g., 5 cm) thereto. The turn into the tee-flue is more gradual (e.g., about 60°). Moreover, as was noted above, both the vertical and horizontal sections of the secondary ducts are preferably angled somewhat rearwardly so as to reduce the angle through which the flow is redirected at each of these turns.

Additional features aid in preserving the integrity of the ducts and other airflow passages, thereby ensuring the adequate draw and velocity is maintained in the secondary ducts. The top panel 52 (see FIG. 6) of the horizontal duct segments is sealed to or formed integrally with the housing so as to ensure a substantially leak-free conduit. Furthermore, as will be discussed in greater detail below, a latch mechanism 160 which secures the barrel/neck 15 to the tubular wand or other conduit leading to the vacuum body is provided with a resilient gasket that forms a leak-free seal.

d. Power Nozzle Components

Other components of the power nozzle incorporating the above-described edge-cleaning features in accordance with a preferred embodiment of the invention will be described with reference to FIGS. 11–14. It will be understood, however, that the edge-cleaning and secondary airflow features of the present invention may be employed with power nozzles having different configurations, or even with unpowered carpet nozzles, as will be described below.

Figure 11:
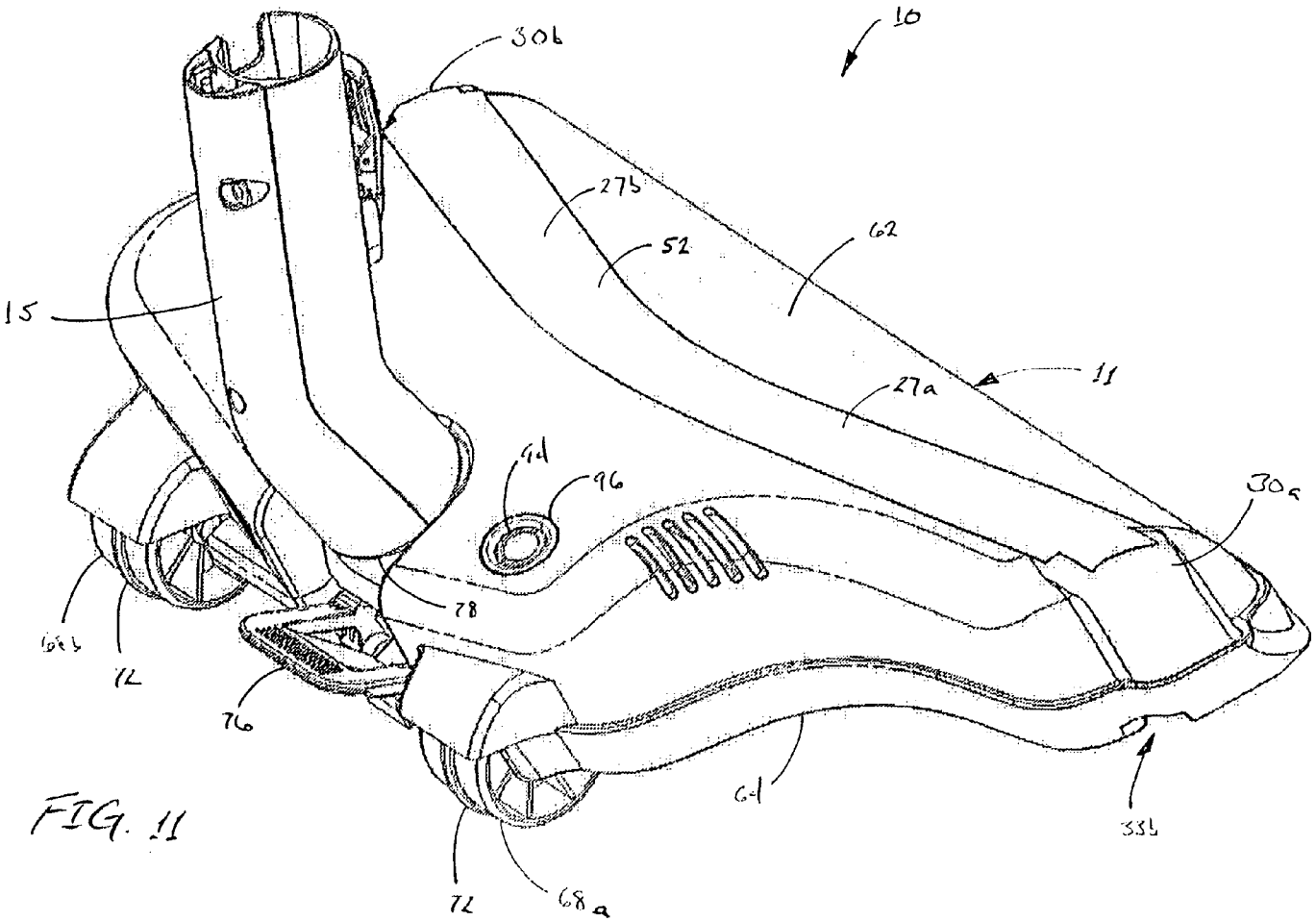
FIG. 11 is a rear upper perspective view of the power nozzle assembly of FIGS. 1–3, showing the intake opening for cooling air on the right side of the housing and also the relationship of the pivoting barrel/neck thereto in greater detail.
Figure 12:
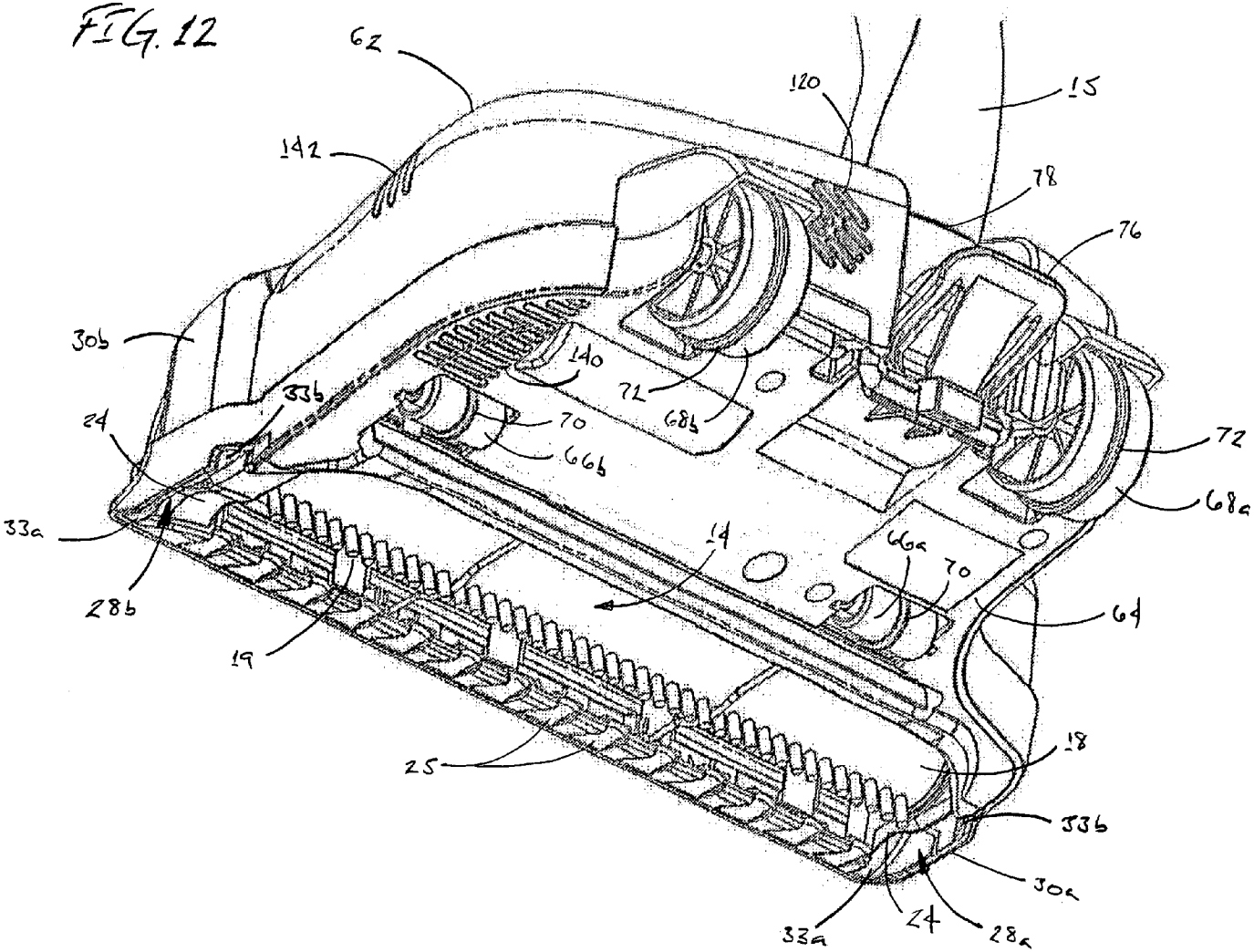
FIG. 12 is a rear, lower perspective view of the power nozzle of FIG. 11, showing the intake and discharge openings for cooling air that is supplied to the drive motor of the assembly.

As can be seen on FIGS. 11 and 12, the housing 11 of the power nozzle of the preferred embodiment includes upper and lower shells 62, 64. The upper shell incorporates the vertical and horizontal segments of the auxiliary suction ducts 27*a*, 27*b*; the top panel 52 of the auxiliary ducts is preferably formed to be clear or translucent, so that the operator can observe passage of debris and can see the end of a wire or other probe in an unlikely event that a blockage needs to be removed. The lower shell 64, in turn, includes the main and auxiliary intake openings and provides the principle structural support for the internal components of the assembly. Forward and rearward sets of generally conventional wheels/rollers 66*a*, 66*b* and 68*a*, 68*b* are mounted in the bottom of the lower shell to support the assembly for movement on the carpet or underlying surface, with narrow resilient tires/rings 70, 72 for use on hard surfaces.

Figure 13:
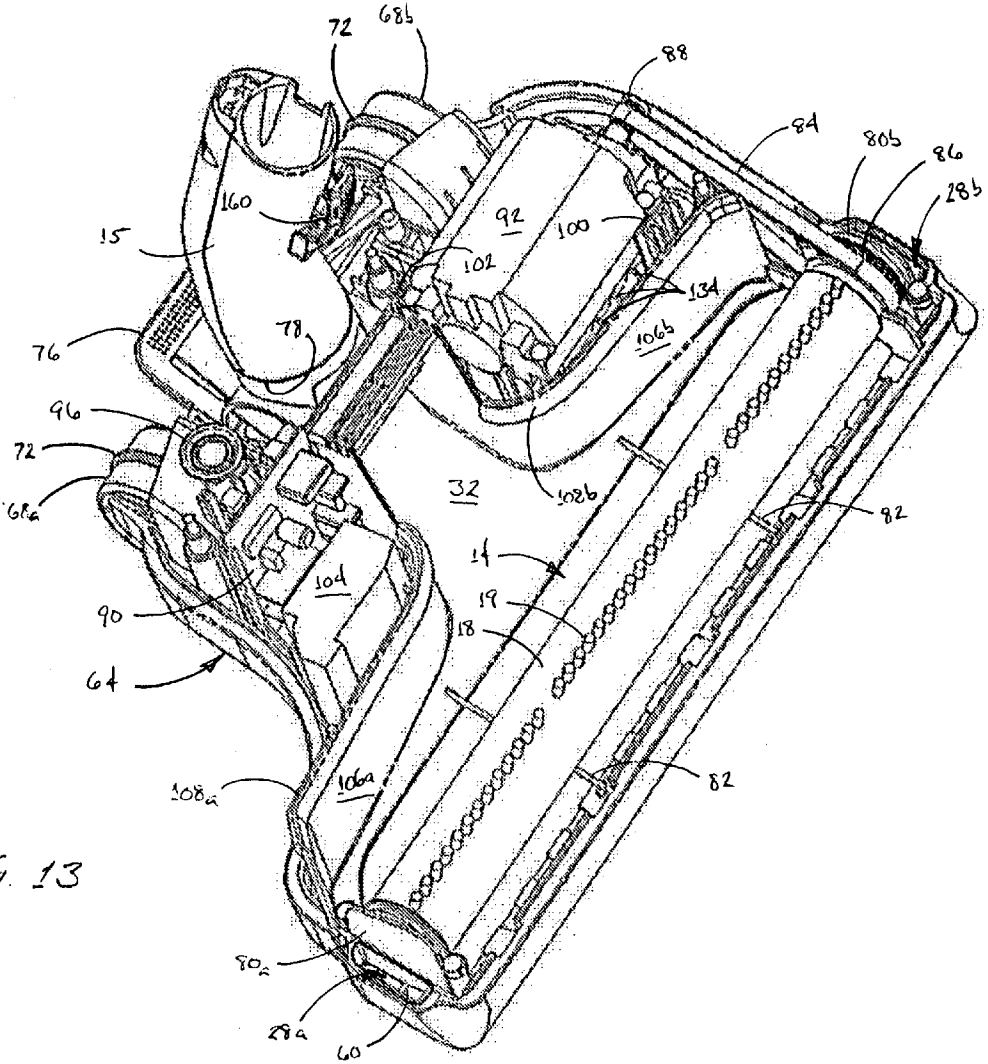
FIG. 13 is a front perspective view of the power nozzle assembly of FIGS. 11–12, with the upper shell of the housing removed, showing the drive motor and associated components of the assembly in greater detail.
Figure 14:
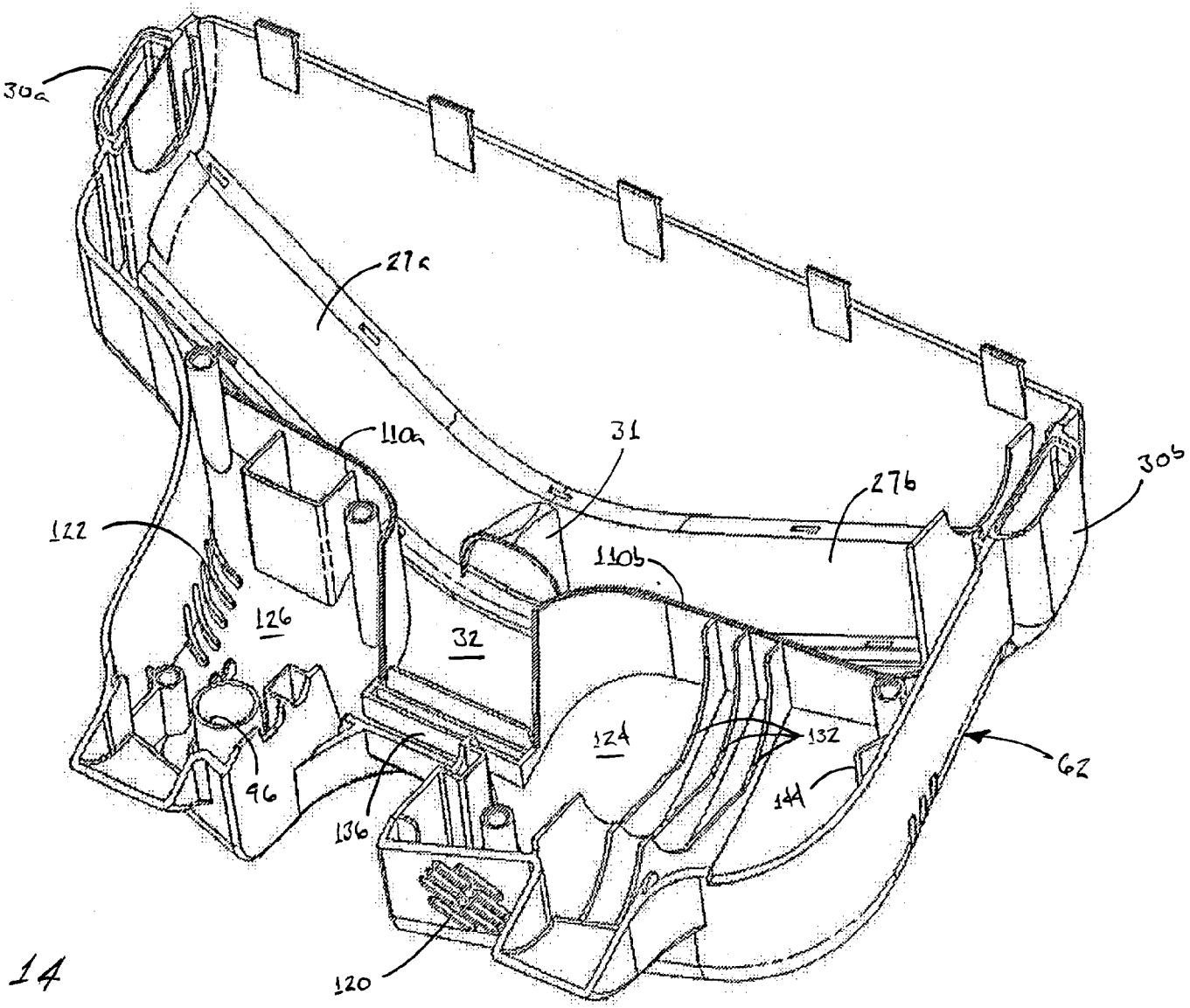
FIG. 14 is a perspective view of the upper shell of the power nozzle assembly of FIGS. 11–13, showing this removed and inverted to illustrate the airflow structures thereof in greater detail.

As can be seen in FIG. 13, the barrel/neck 15 is mounted at the rear of the lower shell for pivoting movement about stub shafts 74 (see FIG. 4), so that the neck pivots downwardly when released by stepping on pedal 76. A rotating sleeve connection 78, in turn, permits the neck and the associated tubular wand to be about the long axis, for example, to permit the nozzle assembly to reach under a chair or other piece of low-lying furniture.

FIG. 13 shows the lower shell 64 with the upper shell of the housing removed. As noted above, the lower shell includes the main intake opening 14. The roller brush extends lengthwise over the main intake opening in a generally conventional manner, and is supported for rotation by bearing units 80*a*, 80*b* that are retained in corresponding recesses in the shell. Guard wires 82 are mounted across the opening to help prevent clothes, edges of rugs, and the like from being picked up and wound about the rotating brush.

The roller brush is of generally conventional configuration, with a suitable drive mechanism being employed. As is shown in FIG. 13, a cogged belt 84 and gear 86 driven by cogged motor pinion 88 is preferable for providing positive rotation of the roller brush and a long service life, as compared to a belt-and-pulley drive. A control/overload protection circuit 90 of conventional design protects the motor 92 from damage in the event that an article (e.g., a sock) is drawn into the opening and stops the roller brush from turning. When an overload condition is detected, the circuit 90 interrupts power to the drive motor and causes a two-color LED to change from green to red, the lens 94 of the LED being visible through a port 96 in the upper shell 62, so as to give the operator a visual indication that the obstruction needs to be cleared. The overload circuit is then reset by switching the main power switch (not shown) off and then on again. It will be understood, of course, that other forms of indicator and reset mechanisms may be employed.

The motor 92 is suitably of a generally conventional type, having, for example, a 2.5 amp rating. The pinion and driven gears 88, 86 are sized to provide a suitable reduction ratio, e.g., giving the roller brush an unloaded speed of about 10–20,000 rpm. The motor is supported by a cradle in the lower shell 64, with support brackets 100, 102 bearing against the casing at predetermined torque angles. A counterweight 104 is mounted in the lower shell generally opposite the motor 92 so as to balance the assembly, assuring even cleaning and also enhancing handling characteristics when in use.

As can be seen in FIG. 13, the lower shell also includes right and left upwardly-extending, smoothly contoured plenum walls 106*a*, 106*b* that direct the primary airflow from the main intake opening 14 into plenum 32, which also receives the secondary airflow from the auxiliary suction ducts as described above. Resilient sealing strips 108*a*, 108*b* are mounted along the upper edges of the plenum walls 106*a*, 106*b* and bear against the lower edges of corresponding, depending walls 110*a*, 110*b* in the upper shell 62 (see FIG. 14) to form a seal that preserves the integrity of the airflow.

Housing 11 also provides a dedicated flow of cooling air for the drive motor 92 and control/overload circuit 90, thereby ensuring efficient operation and longevity of these components; the cooling for corresponding components in prior art power nozzles has typically been inefficient or inadequate, sometimes consisting mainly of air leaking into the housing. Accordingly, the motor 92 (as is conventional) includes an internal fan that draws air axially through the motor and discharges it towards the drive shaft end. As can be seen in the drawings, the upper shell 62 includes primary and secondary intake openings 120, 122 that lead into chambers 124, 126 that house the motor and control/overload circuit components, respectively. Inside chamber 124, a plurality of walls 132 extend transversely to the drive axis of the motor and mate with the outer surface of its housing in close-fitting engagement therewith, so as to both cradle the motor and form a barrier that divides the motor chamber into intake and discharge slides. The walls 132 thus ensure that a positive airflow is provided by the motor fan and also ensure effective cooling by preventing backflow of discharged air over the exterior of the motor.

When motor 92 is in operation, a constant flow of cooling air is thus drawn through the primary intake opening 120. A conduit 136 extends within the housing to establish fluid communication between the motor and circuit chambers 124, 126, so that cooling air is also drawn in through the secondary intake opening 122. The transverse conduit 136 is sized so that adequate cooling flow is provided for the control/overload circuit (e.g., for the a heat sink mounted to the circuit board), but without the main flow of cooling air through the motor, which generates the bulk of the heat. Air that is drawn through both of the intake openings is then discharged on the drive side of the motor, and exits through a grated exhaust opening 140 (see FIG. 12) on the bottom of the discharge side of chamber 124.

The location of the exhaust opening 140 on the bottom of the assembly ensures that both the exhaust airflow and noise are directed away from the operator. Then, when the nozzle assembly is shut off, the exhaust opening 140 acts as an intake opening that allows built-up heat to be cooled from the motor by convection. Air heated by the motor flows upwardly and back out through intake opening 120 and also through a smaller secondary vent 142 on the discharge side of the motor.

Similarly, heat accumulated by the control/overload circuit during operation rises passively through the secondary intake opening 122 when the assembly is idle. The secondary vent 142 is sized to ensure that the bulk of air discharged during operation of the motor exits through the exhaust opening 140 on the bottom of the housing; in addition, an angled baffle 144 (see FIG. 14) is mounted over the inside of the secondary vent to prevent motor noise from escaping.

e. Airtight Neck Latch

As noted above, the vacuum that generates both the primary and secondary cleaning airflows is supplied to the nozzle assembly from another source, depending on the embodiment, such as a vacuum body, or a central vac system, for example. It is therefore desirable to maintain airtight integrity in the tubing or other conduits leading from the vacuum source to the nozzle assembly.

The illustrated embodiment employs the pivoting and rotating barrel/neck 15 having a cylindrical mouth that allows it to be used with a conventional tubular metal vacuum wand. Such wands are conventional, however the locking mechanism by which they attach to the neck of the assembly, typically a simple latch or spring-loaded button, is commonly a source of leakage in prior art nozzle assemblies. The latch assembly 160 of the present invention establishes an effective interlock between the neck and tubular wand while avoiding leakage of air that would compromise the cleaning air flow.

Figure 15:
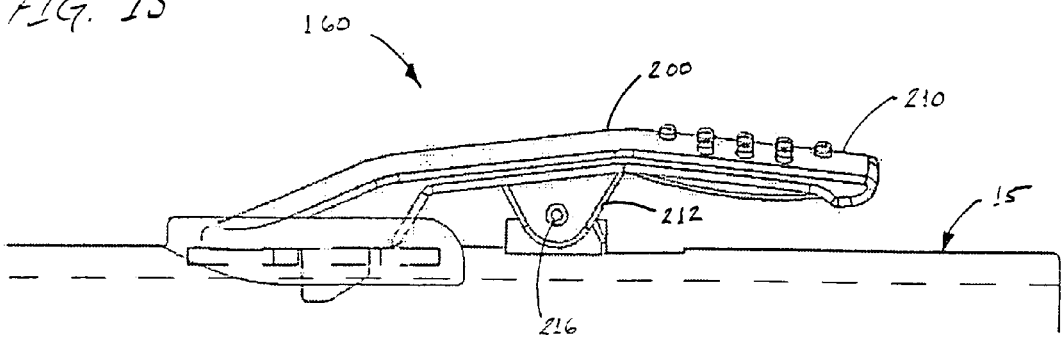
FIG. 15 is a side, elevational view of the latch mechanism of the power nozzle of FIGS. 11–13 that provides a substantially airtight connection with an associated tubular wand that supplies airflow to the assembly.
Figure 16:
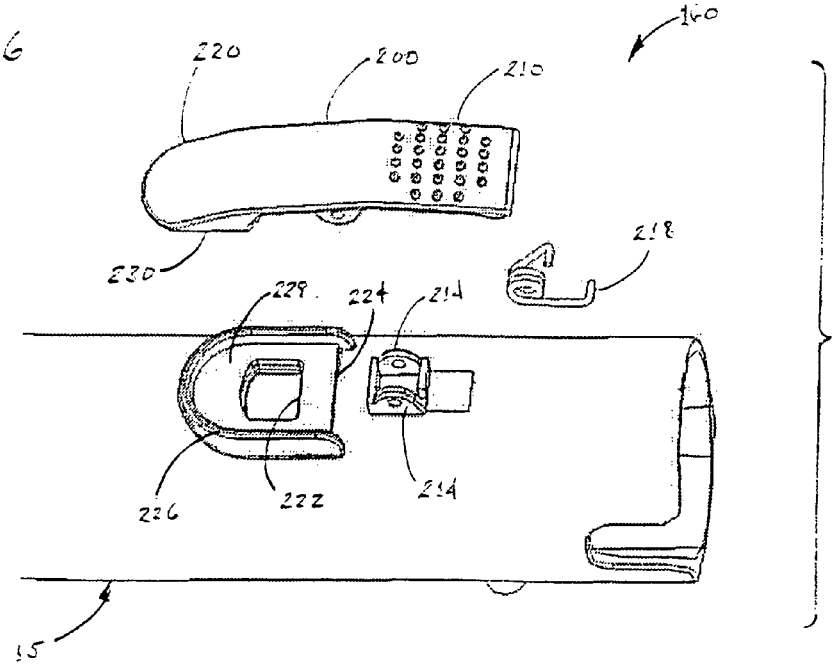
FIG. 16 is a perspective, exploded view of the latch mechanism of FIG. 15, showing the individual components thereof in greater detail.

As can be seen in FIGS. 15–16, the latch assembly 160 includes a latch arm 200 having an angled, suitably textured outer end 210 for being depressed by the thumb of an operator. A depending pivot lug 212 on the bottom of the latch arm interfits with corresponding flanges 214 on the exterior of the neck tube and is joined thereto by an axle pin 216 so as to form a pivot connection. A torsion pull spring 218 is mounted in compression beneath the outer end 210 of the latch arm so as to bias the latch end 220 thereof downwardly through an opening 222 in the neck and into a corresponding latch opening (not shown) in the tubular wand, thereby locking the two members together. To release the assembly, the operator depresses the outer end of the latch arm and withdraws the wand tube from the neck.

As can be seen in FIG. 16, a resilient sealing gasket 224 is mounted within an upstanding retainer wall 226 on the exterior of the tubular neck. The seal member (which may suitably be formed of butyl rubber or other elastomeric material having good sealing and resiliency qualities) has a broad sealing surface 228 on its other side, which engages a corresponding broad mating surface 230 on the underside of the end of the latch arm. The two surfaces thus form an effectively airtight seal when biased into engagement by the force of spring 218, while the retaining wall 226 prevents the resilient gasket from deforming outwardly under pressure.

The latch mechanism 160 thus provides an effective and substantially airtight connection that is economical and durable and easy to use.

f. Example Airflow Patterns in Carpet Nozzle

Similar to FIGS. 7 and 8, FIGS. 17 and 18 illustrate the enhanced airflow patterns that are provided by the present invention when used with an unpowered carpet nozzle.

Figure 17:
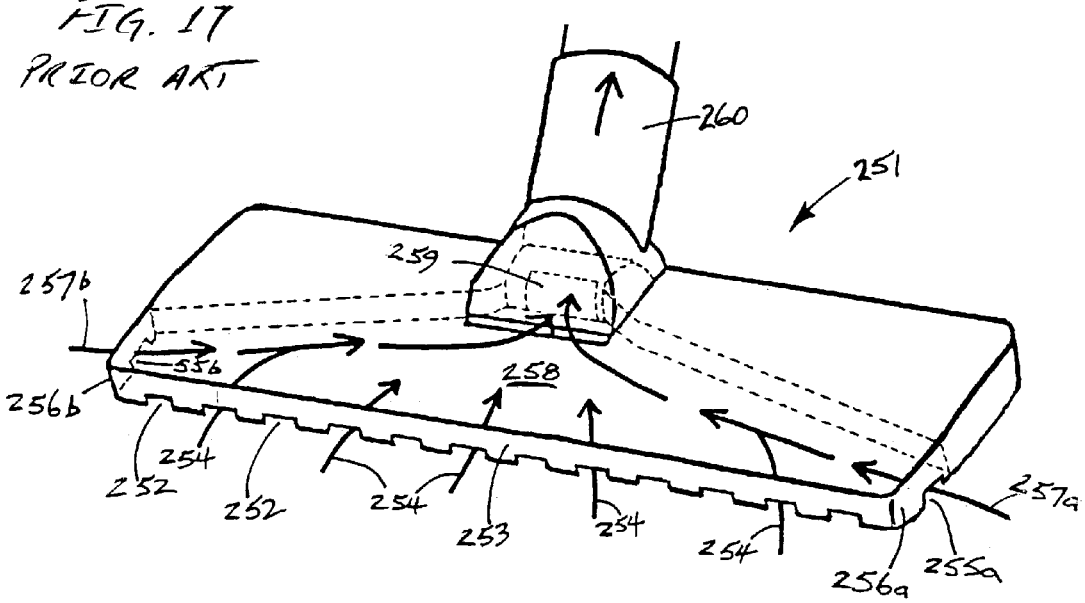
FIG. 17 PRIOR ART
FIG. 17 is a perspective view of a prior art form of an unpowered carpet nozzle assembly, again showing the limited and ineffectual edge-cleaning airflow that is characteristic thereof.

As can be seen in FIG. 17, without the invention the edge-cleaning performance of an unmotorized carpet nozzle assembly 251 is fair at best, although usually evenly balanced on the left and right sides due to the absence of a drive motor/belt. The airflow generated by the vacuum cleaner's suction motor (not shown), draws air through the slots 252 in the nozzle's large front area 253, as shown by arrows 254, and through the small side slots 255*a*, 255*b* on the nozzle's left and right sides 256*a*, 256*b*, as shown by arrows 257*a*, 257*b*. Similar to the manner previously described, air rushes inwardly to a central plenum area 258, carrying dust and dirt into the barrel opening 259 and up through the neck 260 and toward the dirt receptacle (not shown).

Figure 18:
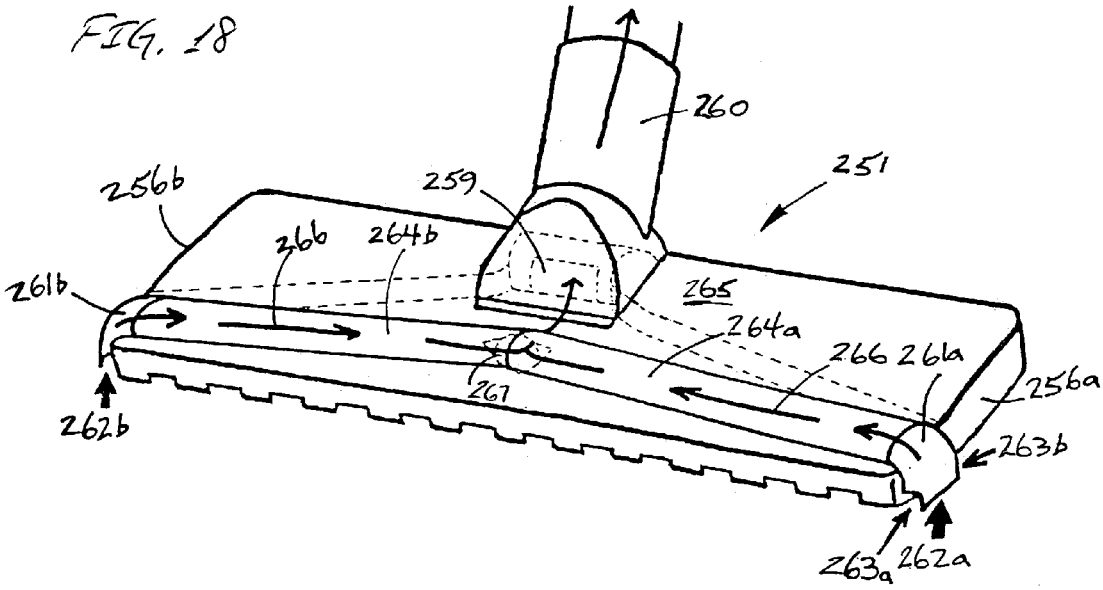
FIG. 18 is a perspective view of a carpet nozzle including auxiliary suction ducts in accordance with the present invention, showing the greatly enhanced edge-cleaning airflow that is provided thereby.

As can be seen in FIG. 18, the invention adds a secondary airflow pattern that augments the primary airflow pattern described above. The secondary airflow pattern includes both:

a) a direct lifting of dust and dirt up into the vertical edge or "crevice" ducts 261*a*, 261*b* at the nozzle's left and right forward sides 256*a*, 256*b*, as indicated by thick arrows 262*a*, 262*b*; and b) a simultaneous pulling of dust and dirt in through the vertical duct segments' leading and trailing cutaway openings, as indicated by arrows 263*a* and 263*b*.

The secondary airflow rushes upwardly through the vertical duct segments 261*a*, 261*b*, then horizontally through left and right horizontal ducts 264*a*, 264*b*, across the nozzle's top area 265, in the directions indicated by arrows 266. The flows merge at the tee-flue 267 which is located centrally and forward of the neck opening 259. As described above, the tee-flue directs the air, dust and dirt downwardly into the common plenum area 258 while simultaneously angling the air, dust and dirt toward the barrel intake opening 259. The secondary airflow then joins the primary airflow, and enters the neck 260 and continues upwardly and into the dirt receptacle (not shown).

d. Additional Configurations

In the embodiments that are shown in the drawings, there are first and second auxiliary suction ducts, one for each side of the assembly. It will be understood, however, that in some embodiments there may be only a single auxiliary suction duct (i.e., for only one side of the assembly), or there may be multiple ducts and/or suction pickup openings along one or both sides of the assembly.

Furthermore, in the illustrative embodiments that have been described above, the auxiliary suction ducts extend across the upper surface of the housing to a central juncture, so that their discharge ends are positioned in close proximity to the intake opening of the nozzle's neck, so as to maximize the strength of the airflow at the intake openings. It will be understood, however, that in some embodiments the auxiliary duct or ducts may be routed along alternative paths, such as, for example, internally within the housing. Moreover, it will be understood that in some embodiments the auxiliary ducts may be comparatively short and may discharge into the plenum only a short distance from their intake openings, or they may be more elongate and may extend further towards the vacuum source, such as, for example, into the tubular handle itself or into a separate, dedicated plenum. Still further, in some embodiments, a second "booster" suction motor may be employed to power the invention and to create the secondary airflow pattern rather than relying on the vacuum cleaner's primary suction motor.

Likewise, the locations and configurations of the auxiliary intake openings may in some embodiments vary from the examples shown herein. For example, the auxiliary intakes may be faired into or embedded within the edge or lower lip of the housing itself, and/or may be extended to the furthest forward position to reach fully into the crevices of 90-degree corners.

It is to be recognized that various alterations, modifications, and/or additions may be introduced into the constructions and arrangements of parts described above without departing from the spirit or ambit of the present invention as defined by the appended claims.

What is claimed is:

1. A vacuum cleaner nozzle assembly, comprising:

a housing;

a primary intake opening on a lower side of said housing;

means for providing suction to said primary intake opening so as to create a primary airflow that draws dirt and debris into said primary intake opening;

at least one auxiliary intake opening located on a side edge of said housing; and an auxiliary suction duct means for supplying suction to said auxiliary intake opening so as to create a secondary airflow that draws dirt and debris into said auxiliary intake opening as said side edge of said nozzle housing is moved along a wall or other obstruction, said auxiliary suction duct means comprising:

a generally vertically-extending end segment having said auxiliary intake opening formed at a lower end thereof, for lifting said dirt and debris upwardly away from a floor surface, said vertical end segment of said auxiliary suction duct having a flattened cross section so as to concentrate said secondary airflow and elongate said opening in a generally lengthwise direction parallel to a forward-to-rearward direction of motion of said nozzle assembly; and a leading cutout formed in a first wall, a trailing cutout formed in a second wall, opposite the first wall, both cutouts;

formed behind a depending outer lip formed on a third side of said vertically-extending end segment for channeling dirt and debris into said auxiliary intake opening as said nozzle assembly is moved in forward and rearward directions.

2. The vacuum cleaner nozzle assembly of claim 1, wherein at least one auxiliary suction duct has a first end in communication with said auxiliary intake opening and a second end which is in communication with an internal chamber of said nozzle assembly to which suction is applied by a vacuum cleaner suction motor.

3. The vacuum cleaner nozzle assembly of claim 2, wherein said internal chamber of said nozzle assembly comprises:

an internal vacuum plenum in communication with said primary intake opening on said nozzle assembly.

4. The vacuum cleaner nozzle assembly of claim 3, wherein said auxiliary suction duct comprises:

a generally horizontally-extending lateral segment for conveying said dirt and debris in said secondary airflow from said generally vertically-extending end segment to said vacuum plenum in said housing.

5. The vacuum cleaner nozzle assembly of claim 4, wherein said primary intake opening extends laterally across said lower side of said housing, and said at least one auxiliary intake opening is located proximate an end of said primary intake opening.

6. The nozzle assembly of claim 5, wherein said at least one auxiliary suction duct comprises first and second said auxiliary suction ducts having first and second auxiliary intake openings located on left and right sides of said housing.

7. The nozzle assembly of claim 6, wherein said nozzle assembly is a power nozzle comprising:

a roller brush mounted above said primary intake opening; and a motor mounted in said housing in drive relationship with said roller brush;

first and second ends of said roller brush being supported for rotation by end supports mounted to said housing across said first and second ends of said primary intake opening.

8. The vacuum cleaner nozzle assembly of claim 7, further comprising:

first and second channels formed across said end supports so as to establish transverse airflow between said primary intake opening and said intake openings of said auxiliary suction ducts.

9. The vacuum cleaner nozzle assembly of claim 4, wherein said auxiliary suction duct is angled so that said secondary airflow passes through a relatively greater angle from said vertically-extending end segment to said horizontally-extending lateral segment, and a relatively lesser angle from said horizontally-extending lateral segment to said internal chamber, so as to facilitate flow of said dirt and debris through said auxiliary suction duct.

10. The vacuum cleaner nozzle assembly of claim 9, wherein said at least one auxiliary suction duct has an interior size that increases progressively from said intake opening to said internal chamber so as to ensure passage of particulate debris therethrough.

11. The vacuum cleaner nozzle assembly of claim 1, further comprising:

means for supplying suction to said vacuum plenum in said housing so as to draw said primary airflow through said primary intake opening and said secondary airflow through said auxiliary suction ducts.

12. The vacuum cleaner nozzle assembly of claim 11, wherein said means for supplying suction to said vacuum plenum comprises:

means for attaching said vacuum cleaner nozzle assembly to a tubular wand of a vacuum cleaner.

13. The vacuum cleaner nozzle assembly of claim 12, wherein said means for attaching said nozzle assembly to said tubular handle comprises:

a hollow neck fitting pivotally mounted to a rearward end of said housing of said nozzle assembly so as to permit said tubular handle to be raised and lowered relative thereto.

14. The nozzle assembly of claim 1, wherein said nozzle assembly is a power nozzle comprising:

a roller brush mounted over said primary intake opening; and a motor mounted in said housing in drive relationship with said roller brush.

15. The nozzle assembly of claim 1, wherein said nozzle assembly is an unpowered carpet nozzle.

16. A vacuum cleaner nozzle assembly, comprising:

a nozzle housing having first and second side edges;

a primary intake opening extending laterally across a lower side of said nozzle housing;

an internal vacuum plenum within said housing in fluid communication with said primary intake opening;

means for supplying suction to said internal vacuum plenum so as to create a primary airflow that draws dirt and debris into said primary intake opening;

first and second auxiliary suction ducts mounted to said housing, each said auxiliary suction duct comprising:

a generally vertically-extending end segment having an intake opening formed at a lower end thereof, said auxiliary intake opening being positioned proximate an end of said primary intake opening; and a generally horizontally-extending lateral segment having a first end mounted to said vertically-extending end segment and a second end that discharges into said vacuum plenum;

so that said suction supplied to said vacuum plenum creates a secondary airflow that draws dirt and debris into said auxiliary intake opening as said side edge of said nozzle assembly is moved along a wall or other obstruction, and so that said generally vertically-extending end segment lifts said dirt and debris and said secondary airflow upwardly away from the floor and said generally horizontally-extending lateral segment conveys the dirt and debris in said secondary airflow to said vacuum plenum of said nozzle assembly;

first and second end supports mounted to said housing between said ends of said primary intake opening and said first and second auxiliary intake openings; and first and second channels formed under said end supports so as to establish airflow paths between said primary intake opening and said first and second auxiliary intake openings.

17. The vacuum cleaner nozzle assembly of claim 16, wherein said second ends of said horizontally-extending segments of said first and second auxiliary suction ducts discharge into said internal vacuum plenum of said nozzle assembly at a common tee flue.

18. The vacuum cleaner nozzle assembly of claim 17, wherein said vertically-extending end segments and horizontally-extending lateral segments of said auxiliary suction ducts are angled rearwardly from said intake openings so as to provide more direct paths for said secondary airflow carrying said dirt and debris.

19. A vacuum cleaner nozzle assembly, comprising a housing:

a primary intake opening on a lower side of said housing, said primary intake opening extending laterally across said lower side of said housing;

means for providing suction to said primary intake opening so as to create a primary airflow that draws dirt and debris into said primary intake opening;

a roller brush mounted above said primary intake opening, said roller brush having first and second ends supported for rotation by end supports mounted to said housing across first and second ends of said primary intake opening;

first and second auxiliary intake openings located on side edges of said housing, said auxiliary intake openings being located proximate said ends of said primary intake opening;

means for supplying suction to said auxiliary intake openings so as to create a secondary airflow that draws dirt and debris into said auxiliary intake openings as said side edges of said housing are moved along walls or other obstructions; and first and second channels formed across said end supports so as to establish transverse airflow between said primary intake opening and said intake openings of.

* * * * *